United States Patent [19]

Merry

[11] Patent Number: 4,929,429

[45] Date of Patent: May 29, 1990

[54] CATALYTIC CONVERTER

[75] Inventor: Richard P. Merry, St. Paul, Minn.

[73] Assignee: Minnesota Mining and Manufacturing Company, St. Paul, Minn.

[21] Appl. No.: 155,086

[22] Filed: Feb. 11, 1988

[51] Int. Cl.[5] ..... F01N 3/28

[52] U.S. Cl. ..... 422/179; 422/221

[58] Field of Search ..... 422/179, 221, 180, 222; 60/299, 301

[56] References Cited

U.S. PATENT DOCUMENTS

| | | | |
|---|---|---|---|
| Re. 27,747 | 9/1973 | Johnson | 163/166 |
| 3,876,384 | 4/1975 | Santiago et al. | 422/179 |
| 4,269,807 | 5/1981 | Bailey et al. | 422/180 X |
| 4,279,864 | 7/1981 | Nara et al. | 422/179 |
| 4,305,992 | 12/1981 | Langer et al. | 428/324 |
| 4,381,590 | 5/1983 | Nonnenmann et al. | 29/157 R |
| 4,617,176 | 10/1986 | Merry | 422/179 |
| 4,693,338 | 9/1987 | Clerc | 181/231 |

FOREIGN PATENT DOCUMENTS

| | | |
|---|---|---|
| 1452982 | 1/1974 | United Kingdom . |
| 2171180A | 2/1986 | United Kingdom . |

OTHER PUBLICATIONS

SAE Technical Paper Series 850131 Metal Supports for Exhaust Gas Catalysts.

*Primary Examiner*—Michael S. Marcus
*Assistant Examiner*—Lynn M. Kummert
*Attorney, Agent, or Firm*—Donald M. Sell; Terryl K. Qualey; David W. Anderson

[57] ABSTRACT

A catalytic converter utilizing a resilient, flexible shot-free ceramic fiber containing mounting mat for mounting a monolith with a metallic casing is disclosed. The mounting mat may be comprised of shot-free composite of shot-free ceramic fibers in combination with an intumescent sheet material.

14 Claims, 1 Drawing Sheet

CATALYTIC CONVERTER

BACKGROUND OF THE INVENTION

The present invention relates to a catalytic converter for an automotive exhaust system comprising a metallic casing with a catalyst support (monolith) securely mounted within the casing by a resilient, flexible ceramic fiber containing mounting mat. The mounting mat may be comprised of ceramic fiber alone or preferably is comprised of a composite of ceramic fiber in combination with an intumescent sheet material.

Catalytic converters are universally employed for oxidation of carbon monoxide and hydrocarbons and reduction of the oxides of nitrogen in automobile exhaust gases in order to control atmospheric pollution. Due to the relatively high temperatures encountered in these catalytic processes, ceramics have been the natural choice for catalyst supports. Particularly useful supports are provided by ceramic honeycomb structures as described, for example, in U.S. Pat. Re 27,747.

More recently, catalytic converters utilizing metallic catalyst supports (metallic monoliths) have also been used for this purpose. (See, for example, UK Pat. No. 1,452,982, U.S. Pat. No. 4,381,590 and SAE paper 850131.) The metallic monoliths have better thermal shock resistance and offer lower back pressure due to reduced wall thickness of the monolith forming the gas flow channels.

The metallic monoliths are normally welded or brazed directly onto the outer metallic casing of the catalytic converter which becomes very hot because the heat of the exhaust gas is readily conducted by the metallic monolith to the casing. The high casing temperature can result in undesirable heating of surrounding areas, such as the floorboard and passenger compartment, as well as creating a risk of grass fires when a vehicle is driven off-road or parked. In addition, when such a catalytic converter is subjected to repeated quenching as, for example, when driving through puddles of water, thermal fatigue of the solder joints holding the layers of the honeycomb structure of the metallic monolith together can result. It is, therefore, desirable to mount the metallic monolith in the metallic casing with a mat which provides thermal insulation.

Catalytic converters with ceramic monoliths have a space or gap between monolith and metal casing which increases during heating because of differences in thermal expansion; in the case of catalytic converters with metallic monoliths, this gap decreases upon heating. This is so, even though the thermal expansion coefficients of the metallic monolith and metal casing are similar since the metallic monolith becomes much hotter than the metallic casing resulting in a decreased gap between the two elements. Conventional intumescent mat mounting materials lack the high temperature resiliency needed to continue to provide support for metallic monoliths as the converter is cycled between high and low temperatures.

Prior efforts to produce catalytic converters having ceramic catalyst supports mounted with ceramic fibrous mats include UK Patent Application 2,171,180 A which relates to ceramic and mineral fibrous materials for mounting ceramic monoliths in catalytic converters. The fibrous material is wrapped and compressed under vacuum and sealed in a substantially air impervious plastic envelope or pouch. In use, the plastic will degrade or burn and release the fibrous material so that it expands to hold the ceramic monolith securely.

U.S. Pat. No. 4,693,338 relates to a catalytic converter comprising a ceramic monolith with a blanket of fibers having high resistance to high temperatures between the monolith and the metallic case, the blanket being substantially devoid of binder and devoid of water of constitution and being highly compressed, and a sealing element (gas seal) surrounding the end of the ceramic monolith which is adjacent the outlet of the converter.

SUMMARY OF THE INVENTION

The present invention relates to a catalytic converter comprising a catalyst support resiliently mounted in a metallic casing and which utilizes a resilient, flexible ceramic fiber containing mounting mat for mounting the monoliths. The mounting mat comprises a fibrous mat of essentially shot-free ceramic fibers. Since ceramic fibers, in mat form, tend to be quite bulky, handling is markedly improved by stitchbonding the fibrous mat material with organic thread. A thin layer of an organic or inorganic sheet material can be placed on either or both sides of the mat during the stitchbonding process to prevent the organic threads from cutting through the ceramic fiber mat. In situations where it is desired that the stitching thread not decompose at elevated temperatures, an inorganic thread such as ceramic thread or stainless steel thread can be used.

DETAILED DESCRIPTION OF THE INVENTION

Figure 1:
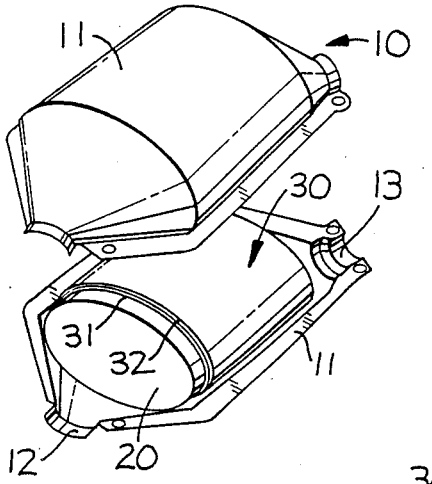
FIG. 1 is a perspective view of a catalytic converter of the present invention shown in disassembled relation.
Figure 2:
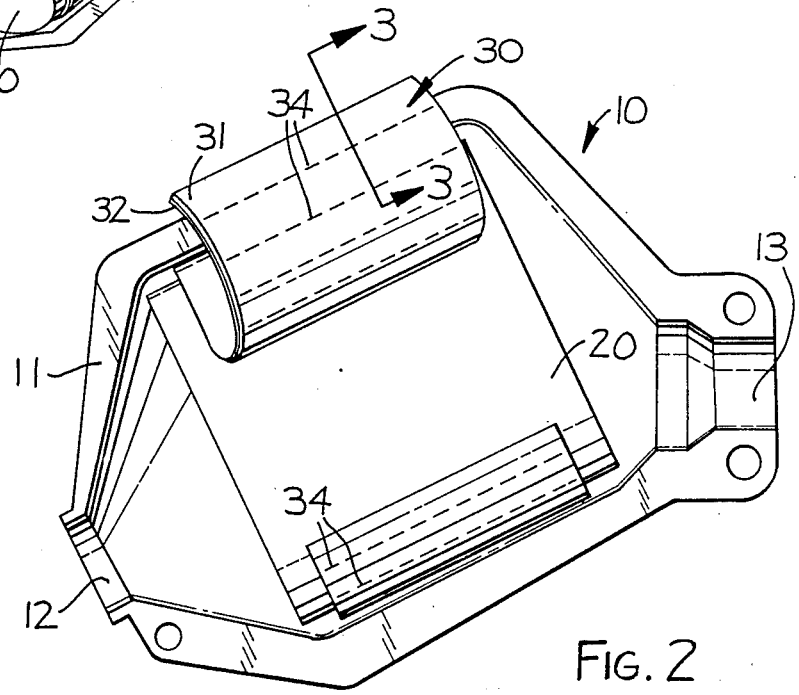
FIG. 2 is a plan view of the bottom shell of the catalytic converter of FIG. 1 showing the ceramic fiber containing mounting mat about the periphery of the metallic monolith.
Figure 3:
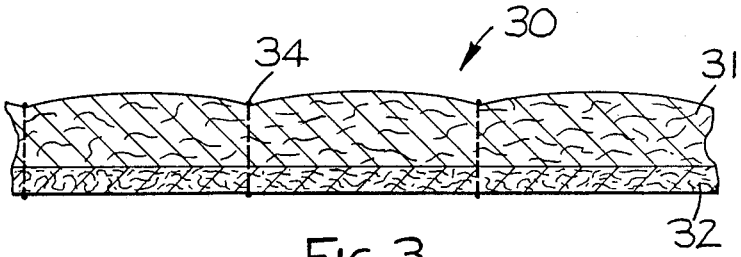
FIG. 3 is a schematic sectional view along the line 3—3 of FIG. 2 of the resilient, flexible ceramic fiber containing mounting mat of this invention.

Referring now to the drawings, catalytic converter 10 comprises metallic casing 11 with generally frustoconical inlet and outlet ends 12 and 13, respectively. Disposed within casing 11 is a monolithic catalytic element 20 formed of a honeycombed monolithic body, preferably a metallic monolith, having a plurality of gas flow channels (not shown) therethrough. Surrounding catalytic element 20 is mounting mat 30 comprising a resilient, flexible, fibrous mat of shot-free ceramic fibers which serves to tightly but resiliently support catalytic element 20 within the casing 11. Mounting mat 30 holds catalytic element 20 in place in the casing and seals the gap between the catalytic element 20 and casing 11 to thus prevent exhaust gases from by-passing catalytic element 20.

Shot-free ceramic fibers useful in forming mounting mat 30 are those commercially available under the tradenames Nextel Ultrafiber 312, Nextel Ultrafiber 440, Nextel Ultrafiber $Al_2O_3$, Nextel Ultrafiber $Al_2O_3$-$P_2O_5$, Nextel Ultrafiber ZS-11, Fibermax fiber and Saffil fiber. When compressed to a mount density of between 0.21 and 0.50 g/cm$^3$, these mats have the unique ability to repeatedly undergo a reduction in thickness while hot and spring back to substantially their original thickness when cooled, thus continually exerting a substantial holding force to catalytic element 20. Since these fiber materials are generally available in the density range of 0.020 to 0.060 g/cm$^3$, they must be compressed by about a factor of 10 when used to mount catalytic element 20. Mat thicknesses of from 2 to 25 cm are generally compressed by stitchbonding to a thickness of 4 to 25 mm for installation into a 2 to 12 mm gap for mounting monoliths in catalytic converters. In a preferred embodiment, mounting mat 30 is comprised of a layer of ceramic fibers 31 in combination with a layer of intumescent sheet material 32 to enhance the hot holding force of the mounting mat while maintaining its resiliency. Tests have shown that to be effective, the mounted thickness of the intumescent sheet material 32 should not exceed the mounted (compressed) thickness of the ceramic fiber layer.

Only substantially shot-free ceramic fibers, formed by sol gel processes, of greater than 5 cm fiber length and a diameter of 2 to 10 microns, seem to offer the high degree of resiliency needed for mounting monolith 20, especially metallic monoliths. Conventional ceramic fibers formed by melt processes such as are available under the tradenames Fiberfrax or Cerafiber contain shot particles and lack the desired properties as the following tests will show. As used herein, "shot-free" refers to a fiber mass containing essentially no particulate ceramic (shot).

Intumescent sheet material 32 comprises a thin, resilient, flexible, intumescent sheet comprising from about 20% to 65% by weight of unexpanded vermiculite flakes, such flakes being either untreated or treated by being ion exchanged with an ammonium compound such as ammonium dihydrogen phosphate, ammonium carbonate, ammonium chloride or other suitable ammonium compound; from about 10% to 50% by weight of inorganic fibrous material including aluminosilicate fibers (available commercially under the tradenames Fiberfrax, Cerafiber, and Kaowool), asbestos fibers, glass fibers, zirconia-silica fibers and crystalline alumina whiskers; from about 3% to 20% by weight of binder including natural rubber latices, styrene-butadiene latices, butadiene acrylonitrile latices, latices of acrylate or methacrylate polymers and copolymers and the like; and up to about 40% by weight of inorganic filler including expanded vermiculite, hollow glass microspheres and bentonite. The thin sheet material is available in a thickness of from 0.5 to 6.0 mm under the tradename Interam mounting mat.

Because of the low density and bulky nature of shot-free ceramic fibers and the fact that they must normally be compressed by about a factor of 10 to get the desired mount density, it has been found useful to sew or stitchbond these materials with an organic thread to form a compressed mat that is closer to its ultimate thickness in use. When a layer of intumescent material is included, it is stitchbonded directly to the fiber mat. In addition, it is sometimes useful to add a very thin sheet material as a backing layer to both sides of the mounting mat as it is being sewn in order to prevent the stitches from cutting or being pulled through the ceramic fiber mat. The spacing of the stitches is usually from 3 to 30 mm so that the fibers are uniformly compressed throughout the entire area of the mat.

A mounting mat of shot-free ceramic fiber (Nextel Ultrafiber 312) approximately 45 mm thick was stitchbonded both with and without an additional 1.5 mm thick layer of intumescent sheet material (Interam mat Series IV). The mat was stitchbonded (sandwiched) between two thin sheets (about 0.1 mm thick) of nonwoven high density polyethylene (CLAF 2001). The mat was stitchbonded using 150 denier polyester thread consisting of 36 ends although any thread having sufficient strength to keep the materials compressed could be used. A chain stitch 34 consisting of 30 stitches per 10 cm was used with a spacing of about 10 mm between stitch chains. The material was compressed to a thickness of 6.2 to 6.5 mm during stitching. The resulting stitchbonded thickness of mat was about 7.0 mm without the intumescent sheet material and about 8.1 mm with the intumescent sheet material In the latter case the intumescent sheet material comprised about 7% of the overall thickness of the stitchbonded composite.

A test to determine the resilient pressure exerted by various monolith mounting mats against metallic monoliths was performed. The apparatus consisted of two stainless steel anvils containing cartridge heaters so that temperatures actually encountered by catalytic converters could be simulated. The gap or distance between the anvils can also be set to actual converter use conditions (decreased with increasing temperatures). Various mounting mats were placed between the anvils with both anvils at room temperature (R.T.). They were then closed to a 4.24 mm gap and the pressure recorded. The anvils were then heated so that the top anvil was at 800° C. and bottom one at 530° C. and the gap simultaneously reduced to 3.99 mm. Pressure was again recorded. Finally, the heaters were shut off and both anvils cooled back to room temperature while adjusting the gap back to the original 4.24 mm. Pressure was recorded once more. The data generated from testing various mounting mats is shown in Table 1.

TABLE 1

| Mounting Mats | Mount Density (g/cm$^3$) | Pressure (kPa) Exerted at Various Temperatures | | |
|---|---|---|---|---|
| | | R.T./R.T. @ 4.24 mm gap | 800° C./530° C. @ 3.99 mm gap | Ret. to/R.T. @ 4.24 mm gap |
| Ceramic Fiber/Intumescent Composite (Nextel Ultrafiber 312/Interam Series IV (1.7 mm)) | 0.416 | 137.9 | 227.5 | 75.8 |
| Stitchbonded Ceramic Fiber/Intumescent Composite (Nextel Ultrafiber 312/Interam Series IV (1.4 mm)) | 0.394 | 117.2 | 117.2 | 41.4 |
| Ceramic Fiber (Nextel Ultrafiber 312) | 0.270 | 96.5 | 124.1 | 55.2 |
| Ceramic Fiber (Nextel Ultrafiber 440) | 0.329 | 206.8 | 268.9 | 96.5 |
| Ceramic Fiber (Nextel Ultrafiber $Al_2O_3$) | 0.306 | 124.1 | 89.6 | 41.4 |
| Ceramic Fiber (Fibermax Fiber) | 0.320 | 151.6 | 75.8 | 55.1 |
| Ceramic Fiber (Saffil Fiber) | 0.284 | 41.4 | 62.1 | 34.5 |
| Ceramic Fiber (Fiberfrax Fiber) | 0.284 | 96.5 | 68.9 | 0 |
| Intumescent Mat (Interam Series III) | 0.693 | 34.5 | 475.8 | 0 |
| Intumescent Mat (Interam Series IV) | 0.912 | 55.2 | 910.1 | 0 |
| Ceramic Fiber (Cerafiber (washed) (5.2% shot)) | 0.291 | 172.4 | 75.8 | 0 |
| Ceramic Fiber (Nichias (8% shot)) | 0.302 | 186.2 | 55.2 | 0 |

It will be observed that shot-free ceramic fiber containing mounting mats of this invention continued to exert sufficient force at all temperatures, including a return to room temperature, while mats containing only conventional materials did not. The preferred combination of shot-free ceramic fibers (Nextel Ultrafiber) and the intumescent sheet material (Interam mat) produced a very significant increase in holding force at high temperature while still maintaining adequate holding force at room temperature.

Various mat materials were also tested to determine their suitability to securely hold metallic and ceramic monoliths in catalytic converters using a hot shake test. This test involved passing exhaust gases through the converter while simultaneously subjecting it to mechanical vibration. The vibration is supplied by an electromechanical vibrator made by Unholtz-Dickie Corp. An acceleration of up to 40 g's at 100 Hz frequency is applied to the converter. The heat source is a natural gas burner capable of supplying to the converter an inlet gas temperature of 1000° C. The exhaust gas temperature is cycled in order to properly test the mounting materials ability to maintain its resiliency and corresponding holding force while the space it occupies is changing dimension. One cycle consists of 10 minutes at 1000° C. and 10 minutes with the gas shut off. Vibration is maintained throughout the thermal cycle. The duration of the test is 20 cycles. The test results are shown in Table 2.

TABLE 2

| Mat Material | Mount Density ($g/cm^3$) | Results |
|---|---|---|
| Intumescent sheet (Interam Mat Series IV) | 0.64 | Fail first cycle |
| Intumescent sheet (Interam Mat Series IV) | 0.88 | Fail first cycle |
| Intumescent sheet (Interam Mat Series IV) | 1.12 | Fail first cycle |
| Intumescent sheet (Interam Mat Series III) | 0.64 | Fail first cycle |
| Ceramic Fiber (Fiberfrax Fiber) | 0.48 | Fail first cycle |
| Wire Mesh | N/A | Fail first cycle |
| Ceramic Fiber (Nextel Ultrafiber 312) | 0.20 | Fail first cycle |
| Ceramic Fiber (Nextel Ultrafiber 312) | 0.35 | Pass 20 cycles |
| Ceramic Fiber (Nextel Ultrafiber 312) | 0.43 | Pass 20 cycles |
| Ceramic Fiber (Saffil Fiber) | 0.33 | Pass 20 cycles |
| Ceramic Fiber/Intumescent sheet composite (Nextel Ultrafiber 312/ Interam Mat Series IV (1.7 mm)) | 0.34 | Pass 20 cycles |
| Ceramic Fiber/Intumescent sheet composite (Nextel Ultrafiber 312/ Interam Mat Series IV (1.4 mm)) | 0.54 | Pass 20 cycles* |

*Ceramic monolith. All other conditions identical.

It will again be observed that the shot-free ceramic fiber containing mounting mats of this invention passed this practical test while mounting mats made with conventional materials normally used to make mats for mounting ceramic monoliths did not. It will also be noted that a mounting mat containing melt processed ceramic fibers (Fiberfrax fiber) did not pass this test.

What is claimed is

1. In a catalytic converter having a metallic casing, a unitary, solid catalytic element disposed within said casing, and resilient means disposed between said catalytic element and said metallic casing for positioning said catalytic element and for absorbing mechanical and thermal shock, the improvement comprising; said resilient means being a resilient, flexible, fibrous mat of shot-free ceramic fibers having a stitchbonded compressed thickness in the range of 4 to 25 mm wrapped about the lateral surface of said catalytic element to a mount density of about 0.25 to about 0.50 $g/cm^3$.

2. The catalytic converter of claim 1 wherein the catalytic element is a metallic monolithic body.

3. The catalytic converter of claim 1 wherein the catalytic element is a ceramic monolithic body.

4. The catalytic converter of claim 1 wherein said resilient means additionally comprises a layer of intumescent material.

5. The catalytic converter of claim 4 wherein the catalytic element is a metallic monolithic body.

6. The catalytic converter of claim 4 wherein the catalytic element is a ceramic monolithic body.

7. The catalytic converter of claim 4 wherein said layer of intumescent material has a thickness not greater than the thickness of said ceramic fiber mat.

8. The catalytic converter of claim 7 wherein said layer of intumescent material comprises from about 20% to 65% by weight of unexpanded vermiculite flakes, from about 10% to 50% by weight of inorganic fibrous material, from about 3% to 20% by weight of binder and up to about by weight of inorganic filler material.

9. The catalytic converter of claim 8 wherein said unexpanded vermiculite flakes have been ion-exchanged with an ammonium compound.

10. The catalytic converter of claim 8 wherein said inorganic fibrous material is alumina-silicate fibers, asbestos fibers, glass fibers, zirconia-silica fibers or crystalline alumina whiskers.

11. The catalytic converter of claim 8 wherein said binder is a latex of natural rubber, styrene-butadiene copolymers, butadiene-acrylonitrile copolymers, acrylate polymers or methacrylate polymers.

12. The catalytic converter of claim 8 wherein said inorganic filler is expanded vermiculite, hollow glass microspheres or bentonite.

13. The catalytic converter of claim 1 wherein said shot-free ceramic fiber comprises alumina-boria-silica fibers, alumina-silica fibers, alumina-phosphorus pentoxide fibers, zirconia-silica fibers and alumina fibers.

14. The catalytic converter of claim 13 wherein said shot-free ceramic fiber is derived from a sol-gel process.

* * * * *

UNITED STATES PATENT AND TRADEMARK OFFICE

CERTIFICATE OF CORRECTION

PATENT NO. : 4,929,429

DATED : May 29, 1990

INVENTOR(S) : Richard P. Merry

It is certified that error appears in the above-identified patent and that said Letters Patent is hereby corrected as shown below:

Title page:

Abstract, line 3, correct "with" to --within--.

Abstract, line 4, after "shot-free" insert --ceramic fibers alone or preferably is comprised of a--.

Claim 3, Col. 6, line 38, after "about" insert --40%--.

Signed and Sealed this

Third Day of September, 1991

*Attest:*

*Attesting Officer*

HARRY F. MANBECK, JR.

*Commissioner of Patents and Trademarks*